US006048266A

United States Patent [19]

Leith

[11] Patent Number: 6,048,266

[45] Date of Patent: Apr. 11, 2000

[54] VENTILATOR

[75] Inventor: Daren Leith, Colchester, United Kingdom

[73] Assignee: Titon Hardware Limited, United Kingdom

[21] Appl. No.: 08/714,091

[22] PCT Filed: Feb. 28, 1995

[86] PCT No.: PCT/GB95/00413

§ 371 Date: Nov. 19, 1996

§ 102(e) Date: Nov. 19, 1996

[87] PCT Pub. No.: WO95/25871

PCT Pub. Date: Sep. 28, 1995

[30] Foreign Application Priority Data

Mar. 18, 1994 [GB] United Kingdom ..... 9405391

[51] Int. Cl.[7] ..... E06B 7/084

[52] U.S. Cl. ..... 454/273; 454/213

[58] Field of Search ..... 454/211, 273, 454/213, 222

[56] References Cited

U.S. PATENT DOCUMENTS

| | | | |
|---|---|---|---|
| 884,598 | 4/1908 | Martin | 454/211 |
| 1,600,369 | 9/1926 | Sochowitz | 454/211 |
| 4,186,656 | 2/1980 | Weber . | |

FOREIGN PATENT DOCUMENTS

| | | | |
|---|---|---|---|
| 0021164 | 6/1980 | European Pat. Off. . | |
| 0475034 | 7/1991 | European Pat. Off. . | |
| 2 658 272 | 8/1991 | France | 454/213 |
| 2135045 | 8/1984 | United Kingdom . | |
| 2 254 138 | 9/1992 | United Kingdom | 454/213 |

*Primary Examiner*—Harold Joyce
*Attorney, Agent, or Firm*—Price, Heneveld, Cooper, DeWitt & Litton

[57] ABSTRACT

A glazed-in ventilator (10) includes a flap (12) which is rotatable about its longitudinal axis. Each end of the flap is connected by a thumb wheel (24) to an end cap (28). Inside the thumb wheel, a series of projections (36) engage a conical surface (34). This engagement provides an axial thrust along the flap which ensures that the structure of the ventilator is rigid. In addition, the ventilator may be manufactured to relatively low tolerances and the friction coupling provided by the engagement of pegs (36) and surface (34) works well even if the flap is not exactly the designed length.

30 Claims, 7 Drawing Sheets

VENTILATOR

The present invention relates to a ventilator, for example to a glazed-in ventilator. A glazed-in ventilator is a ventilator which may be installed between the edge of a window pane (or window panes in the case of multiple glazing) and the window sash or other adjacent structure. The invention may also relate to ventilators such as slot ventilators, which may be installed in apertures formed through or in the region of, such as above, the frames of doors or the frames or sashes of windows.

GB 2135045 discloses a ventilator comprising an elongate flap having first and second ends, first and second connection means located at the first and second ends respectively, the connection means connecting the flap to support means and being arranged to permit the flap to rotate about a longitudinal axis thereof. A problem with this ventilator is that the flap has to be manufactured to very accurate tolerances and, if it is slightly too short, due to the resultant end-float, the structure of the ventilator is not rigid enough, and, if it is too long or too short, the flap is liable to jam in extreme cases. The first and second connection means include friction washers for holding the flap in a selected rotational position. Again, the length of the flap needs to be very accurate since, if the flap is slightly too long, there will be too much friction, and if the flap is too short, there will not be enough.

The present invention aims to alleviate these problems.

According to a first aspect of the present invention, a ventilator comprises an elongate flap having first and second ends, first and second connection means located at the first and second ends respectively, the connection means connecting the flap to support means and being arranged to permit the flap to rotate about a longitudinal axis thereof, and biassing means arranged to bias the first end along the longitudinal axis. This has the advantage that the structure of the ventilator is more rigid than in the prior art. The biassing means may be included in the first connection means.

Preferably, the biassing means is arranged to bias the first end of the flap towards the second end of the flap.

In a preferred embodiment, the biassing means comprises a bearing element located on one of the first end and the support means, and a resilient projection carried on the other of the first end and the support means, the bearing element having a generally conical or tapered bearing surface substantially coaxial with the longitudinal axis of the flap, the projection engaging the tapered bearing surface. In this case, the projection may engage the bearing surface frictionally to couple the rotational orientation of the flap relative to the support means.

According to a second aspect of the present invention, there is provided a ventilator comprising an elongate flap having first and second ends, first and second connection means located at the first and second ends respectively, the connection means connecting the flap to support means and being arranged to permit the flap to rotate about a longitudinal axis thereof, the first connection means including a friction coupling comprising a bearing element located on one of the first end and the support means, and a resilient projection carried on the other of the first end and the support means, the bearing element having a substantially cylindrical, conical or tapered bearing surface substantially coaxial with the longitudinal axis of the flap, the projection engaging the bearing surface frictionally to couple the rotational orientation of the flap relative to the support means. This has the advantage that the flap can be manufactured to a relatively low tolerance without adversely affecting the friction coupling.

Preferably, the exterior bearing surface is tapered or conical.

In each of the aforementioned aspects of the present invention, the first connector preferably includes an intermediate carrier element which carries the projection, and the carrier element is mounted to the first end of the flap. The carrier element may comprise a manually-rotatable operation element for rotating the flap.

In a preferred embodiment, the ventilator includes a series of substantially parallel resilient projections carried on the other of the first end and the support means in the form of a collet substantially coaxial with the bearing surface, each of the projections engaging the bearing surface. When an intermediate carrier element is provided, the series of projections may be carried on the carrier element which is preferably mounted on the first end of the flap. This is a particularly convenient construction because the carrier element and projections may be moulded together in one step.

Preferably, the first and second connection means include respective spigot and bore connections which together define the longitudinal axis of the flap.

The second connection means may be substantially identical to or substantially a mirror image of the first connection means.

In a preferred embodiment, the support means comprises a first end support at the first end of the flap, and a second end support at the second end of the flap, and a first slotted element extending between the end supports, the first slotted element including an aperture having upper and lower edges, the flap being rotatable between a closed position in which upper and lower edges thereof are located adjacent the upper and lower edges of the aperture, and an open ventilation position. In this case, a said upper edge and a said lower edge may include sealing strips for sealing the aperture in the closed position of the flap.

In one embodiment, the ventilator includes a second slotted element which extends between the end supports, the second slotted element being spaced from the first slotted element by upper and lower connector means which extend between the end supports, a second aperture in the second slotted element and the aperture in the first slotted element defining the inlet and outlet of an airflow passage through the ventilator. In this case, the second slotted element preferably includes a weather hood. The second slotted element preferably includes an insect mesh. Preferably, the end supports and upper and lower connector means are of thermally insulating material. This has the advantage that when the ventilator is installed with the slotted element facing into a building, and the second slotted element outside the building, heat cannot easily be transferred from one side to the other of the ventilator undesirably.

In a preferred embodiment, the first and second slotted elements include substantially parallel downwardly depending flanges which are spaced from one another to define a glazing channel.

The present invention may be carried out in various ways and various embodiments of ventilators in accordance with the invention will now be described, by way of example, with reference to the accompanying drawings, in which.

Figure 6:
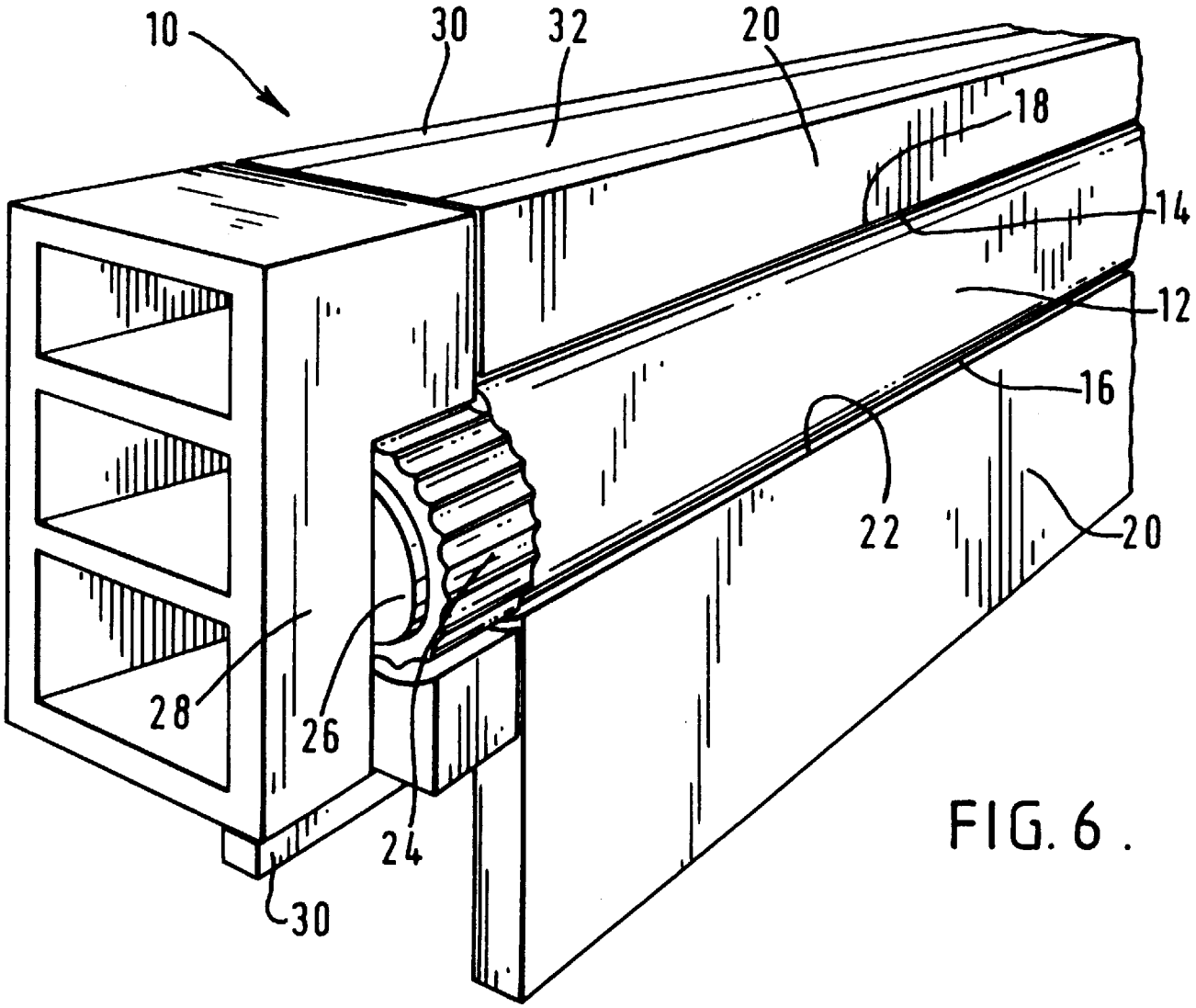
FIG. 6 shows part of an assembled ventilator in accordance with a preferred third embodiment of the present invention.

Referring t o FIG. 6, a preferred embodiment of a ventilator 10 includes an elongate ventilation flap 12. The ventilation f lap has an upper edge 14 and a lower edge 16.

In the position of the ventilation flap 12 shown in FIG. 6, the upper edge 14 of the flap is adjacent the upper edge 18 of an aperture (not shown) in an elongate slotted element 20, and the lower edge 16 of the flap is adjacent the lower edge 22 of the aperture in the elongate slotted element 20.

A thumb wheel 24 is located on one end of the flap 12. A similar thumb wheel (not shown) is mounted on the other end of the f lap. The thumb wheel engages a bearing element 26 of an end cap 28 of the ventilator. The bearing element 26 is fixed stationary relative to the end cap 28. The bearing element 26 may be formed integrally with or separately from the end cap 28.

The other end of t he ventilator (not shown) includes a similar bearing element and end cap. The manner of engagement between the thumb wheel 24 and bearing element 26 will be explained in detail below. It will suffice for now to say that the thumb wheel 24 may be rotated about its axis by up to approximately 90° so that the upper edge of the flap 14 moves away from the upper edge of the aperture 18 in one direction, and the lower edge of the flap 16 moves away from the lower edge of the aperture 22 in the other direction, thereby opening the aperture for airflow therethrough.

The ventilator includes a further elongate slotted element 30 (only partly visible in FIG. 6) which is spaced rearwardly from the elongate slotted element 20. The further elongate slotted element also includes an aperture and, when the thumb wheel 24 and flap 12 are rotated from the position shown in FIG. 6, an airflow path is provided through the ventilator.

The slotted element 20 and further slotted element 30 are joined by an upper connector 32 above the apertures therein, and also by a similar lower connector (not shown) below the apertures. As will be evident from FIG. 6, the end cap 28 and the other end cap (not shown) also connect the two elongate slotted elements 20, 30. The end caps 28 and upper 32 and lower connectors are made of thermally insulating material, such as plastics, for example P.V.C. This has the advantage that when the ventilator is in the closed position shown in FIG. 6, undesirable heat transfer across the ventilator does not occur.

The two slotted elements 20, 30 are preferably extruded from aluminium alloy or another alloy. The upper 32 and lower connectors are preferably extrusions. They may be connected to the slotted elements 20, 30 by rolling or crimping the material of the slotted elements into "V" grooves (not shown) in the upper 32 and lower connectors. Other forms of connection are envisaged.

The further slotted element 30 includes a recess (not shown) which accommodates a canopy section or hood (not shown) for weather protection. The hood may be of a plastics such as P.V.C. or aluminium or similar material, and is preferably a sliding fit in the slotted element 30. In addition, the slotted element 30 includes an insect screen mesh (not shown), for example of aluminium material, for preventing insects such as flies from passing through the ventilator when the flap 12 is open.

One or other of the upper edges of the flap 14 and the aperture 18 includes a longitudinal seal (not shown) for example made of resilient elastomeric material and, likewise, one of the lower edges of the flap 16 and aperture 22 includes an elongate seal. This prevents ingress of air or water.

If the slotted elements 20, 30 are extrusions, they may have a series of holes (not shown) punched through them along their lengths to allow for the passage of air through the ventilator.

The thumb wheel 24 is preferably a plastics moulding, and preferably includes a resilient stop (not shown) which prevents operation past its open and closed positions.

The end cap 28 may be secured to the slotted elements 20, 30 by screws (not shown) such as self-tapping screws.

Figure 1:
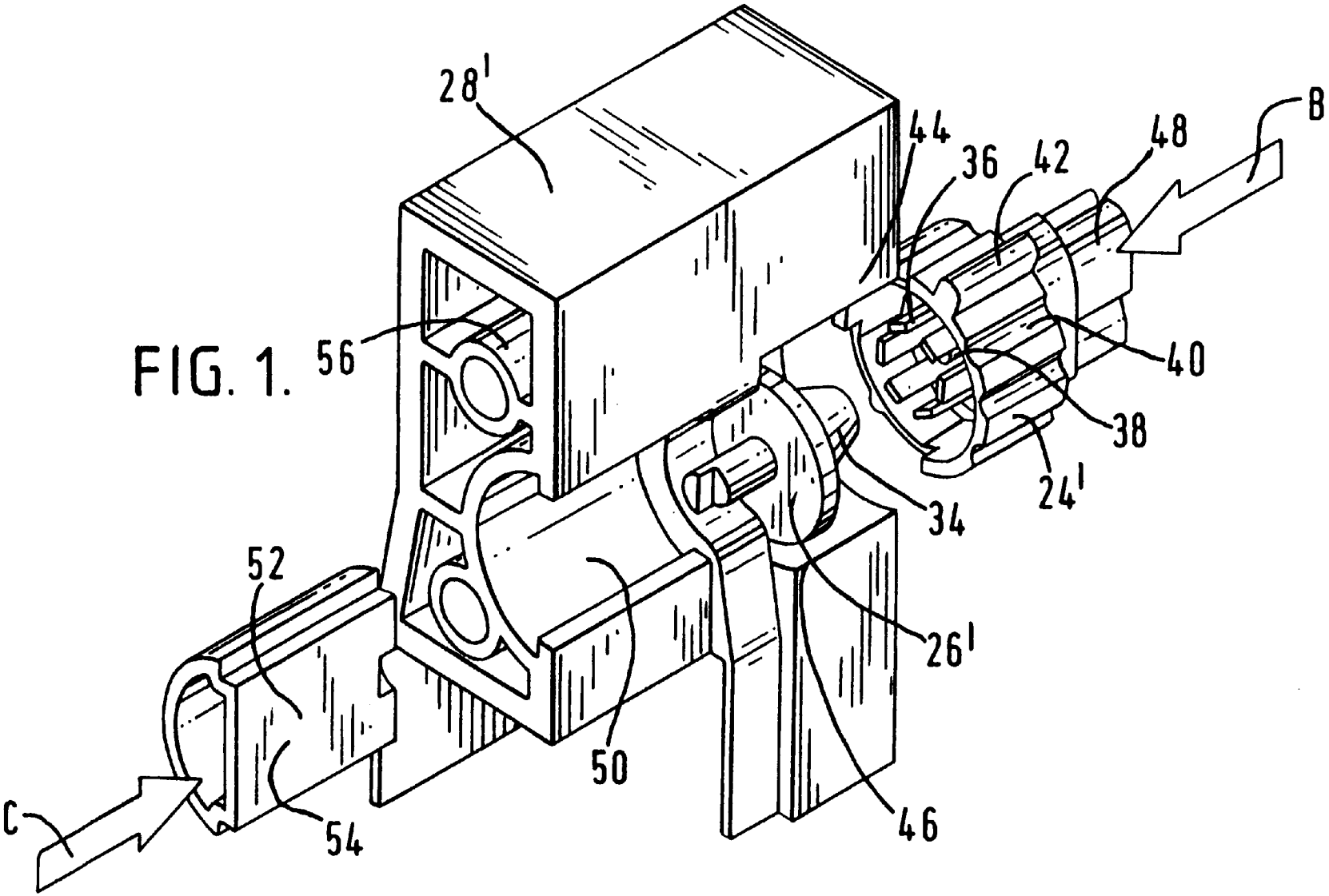
FIG. 1 shows a part isometric exploded view of part of a preferred embodiment of a ventilator in accordance with the present invention.
Figure 2:
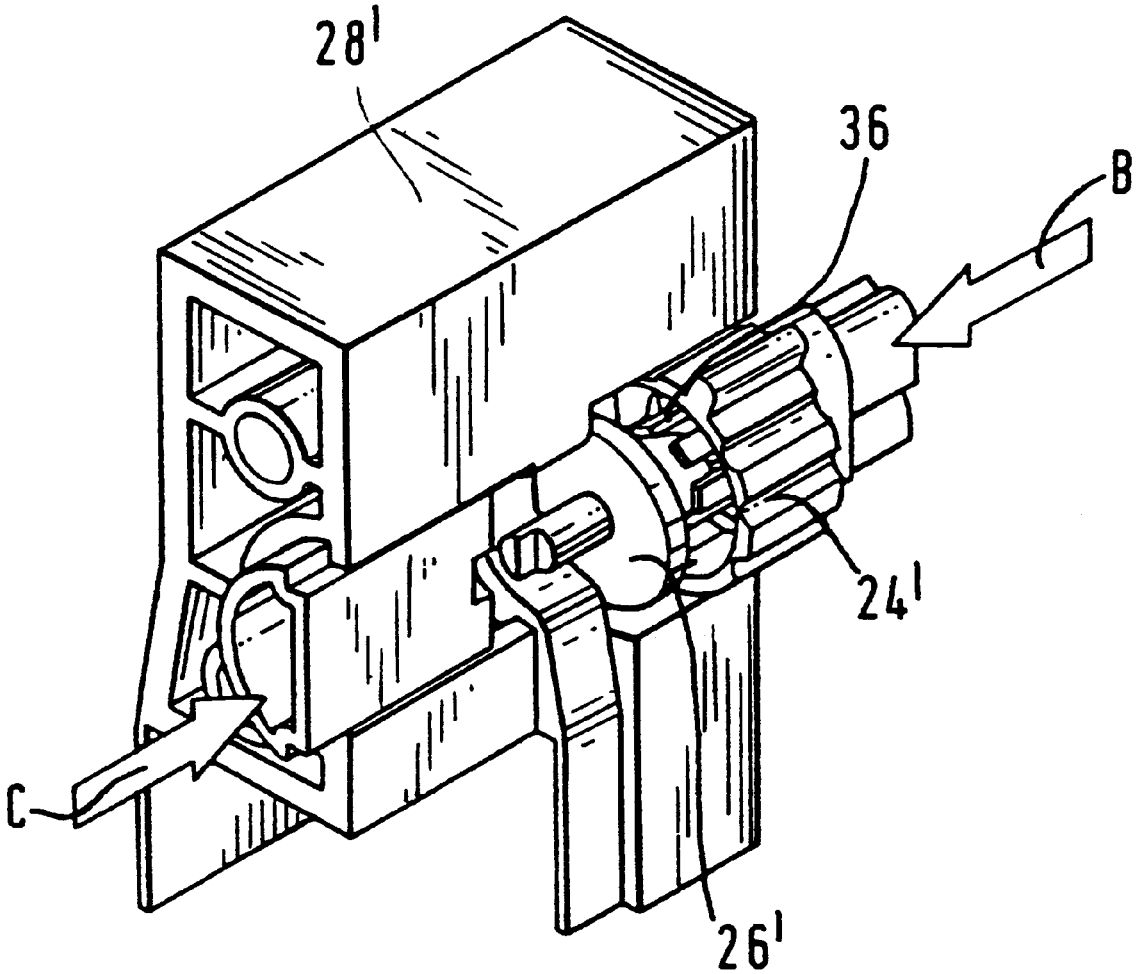
FIG. 2 shows a part assembled view on reduced scale of the part of the ventilator shown in FIG. 1.

The interior of the thumb wheel 24, which is hidden in FIG. 6, is substantially the same as the interior of the thumb wheel 24' of the embodiment shown in FIGS. 1 and 2.

As will be evident from FIG. 1, the end cap 28' has a slightly different form to the end cap 28 of the FIG. 6 embodiment. The FIGS. 1 and 2 embodiment will, it will be realised, once assembled, incorporate a flap, slotted elements and upper and lower connectors similar to those 12, 20, 30, 32 shown in FIG. 6.

The bearing element 26' of the end cap 28' in FIG. 1 includes an exterior conical bearing surface 34. The interior of the thumb wheel 24' includes a series of resilient pegs or tangs 36 arranged in the form of a collet. The pegs 36 are equi-spaced around a spigot 38. When the thumb wheel 34' is moved in the direction B as indicated in FIG. 1, the spigot 38 enters a bore (not shown) in the centre of the conical bearing surface 34 of the bearing element 26', and the resilient pegs 36 are splayed out radially as they engage the conical surface. The engagement between the pegs 36 and the bearing surface 34 is frictional to the extent that the thumb wheel 24' can be turned to a desired angular orientation, and then maintained in that orientation by the frictional engagement. The thumb wheel has a generally corrugated outer surface 40, and is therefore easily manually operated. In addition, a projection 42 is provided, and this serves both to assist in the operation of the thumb wheel, and to act as an end stop, its angular movement being limited by engagement with the adjacent surfaces 44, 46 of the end cap 28.

The thumb wheel 24' includes a connector portion 48 whose exterior section is arranged to mate with the interior section of a groove of the extruded flap 12.

When the ventilator is being manufactured or assembled, the length of the flap relative to the assembled distance between the end caps 28' is not critical. As will be seen from FIG. 2, the pegs 36 begin to engage the bearing element 26' when the thumb wheel is moved in direction B well before the maximum possible movement of the thumb wheel 24' in that direction to the position shown in FIG. 6. This is very advantageous since the friction provided by the engagement between the pegs 36 and the bearing element 26' does not vary a great amount during that movement. Thus, the friction lock provided by the engagement of the pegs 36 and bearing element 26' works well even if the ventilator is manufactured and assembled to relatively low tolerances.

In addition, since the bearing surface 34 of the bearing element 26' is conical, a component of the reaction between the pegs 36 and bearing element 26' acts in the longitudinal direction of the ventilator to bias the thumb wheel 24' away from the end cap 28'. This is highly advantageous since it ensures a rigid engagement between the projection 48 of the thumb wheel and the flap, giving the flap a strong construction which is not liable to jamming. The end-float problem inherent in prior art ventilators is also overcome.

It will also be seen from FIGS. 1 and 2 that the end cap 28' includes a recess 50. This permits easy manufacturing of the end cap 28'. So that the ventilator is aesthetically pleasing once assembled, an insert element 52 is provided. During assembly this is moved from the position shown in FIG. 1 in the direction C. As shown in the part-inserted position of FIG. 2, the front surface 54 of the insert element lies flush with the surface 44 of the end cap 28'.

Figure 3:
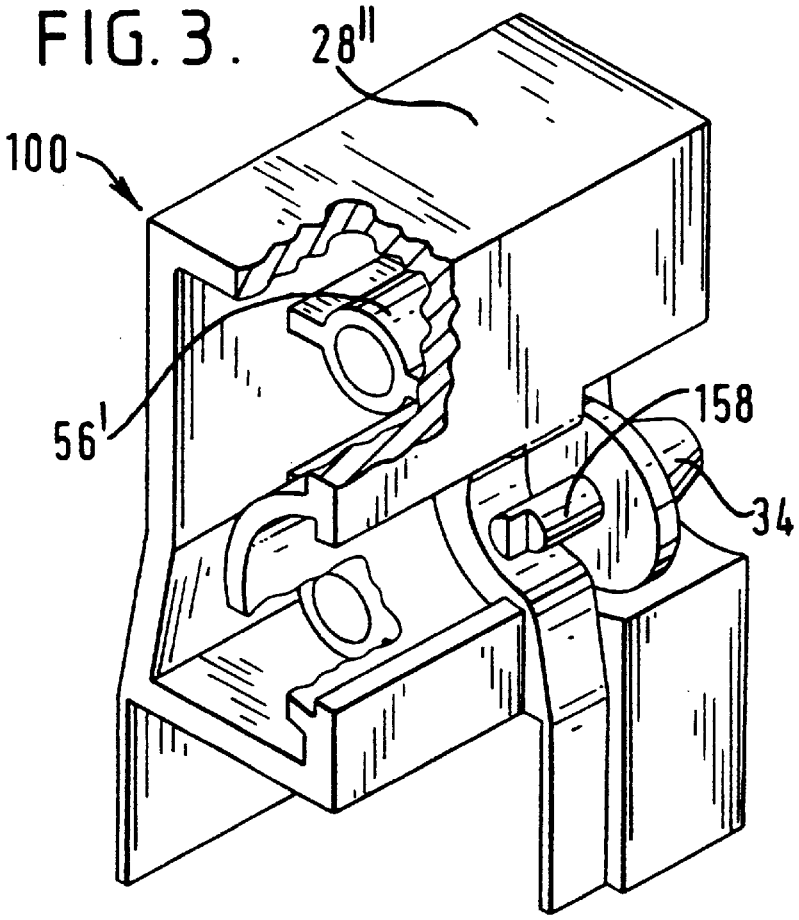
FIG. 3 shows a part isometric view of part of a second preferred embodiment of a ventilator in accordance with the present invention.
Figure 4:
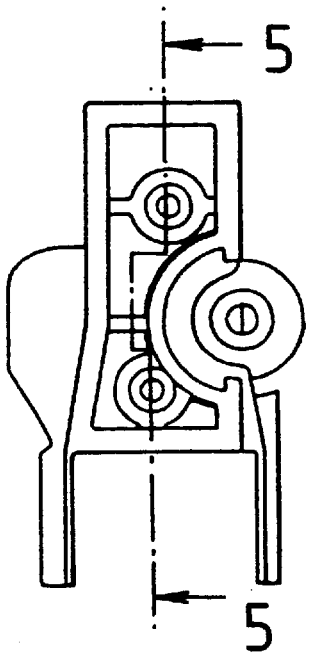
FIG. 4 shows an end view of the part of the ventilator shown in FIG. 3.
Figure 5:
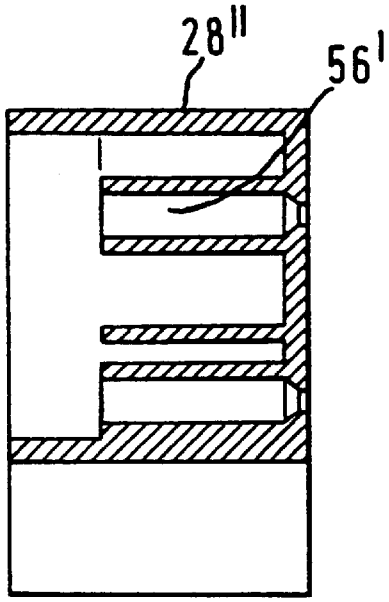
FIG. 5 is a section on the line V—V in FIG. 4.

FIGS. 3 to 5 show part of an embodiment which is identical to that shown in FIGS. 1 and 2 except for its end cap 28". Whereas in the FIGS. 1 and 2 embodiment screw bores 56 for connecting the end cap to the slotted elements end flush with the end of the end cap 28', the screw bores 56' of the FIGS. 3 to 5 embodiment are recessed. Thus, in the FIGS. 3 to 5 embodiment, less material is used during manufacture.

Figures 7A, 7B, 8, 9:
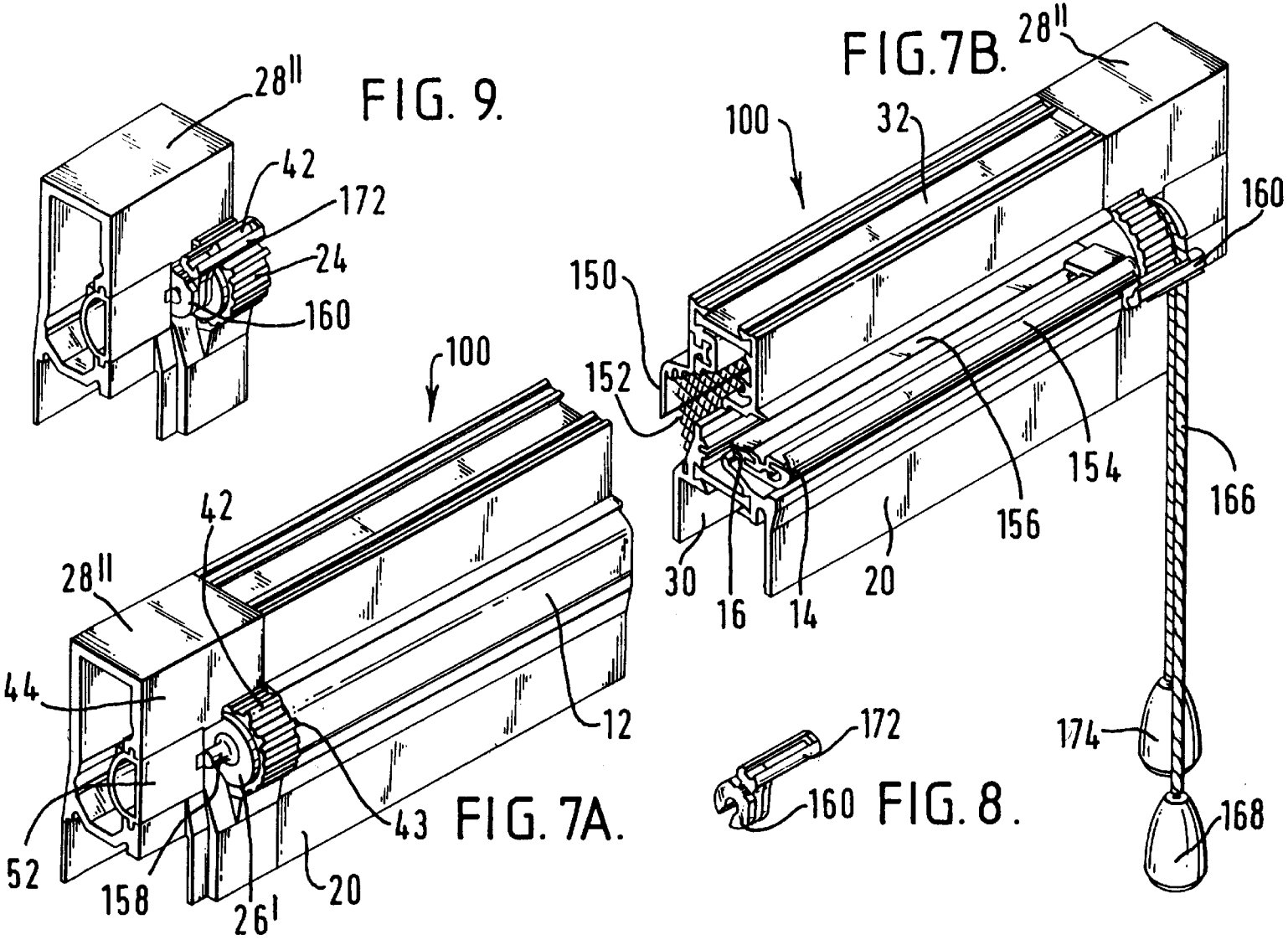
FIG. 7A shows an isometric assembled view of one end of the ventilator of FIGS. 3 to 5, including a flap thereof in a closed position thereof.
FIG. 7B shows the other end of the ventilator to that shown in FIG. 7A with the flap in an open position thereof.
FIG. 8 shows an example of a cord-operated operation device for the ventilator of FIGS. 3 to 5, 7A and 7B.
FIG. 9 shows the operation device of FIG. 8 connected to the ventilator.

FIGS. 7A and 7B show the ventilator 100 of FIGS. 3 to 5 in an assembled state. In FIGS. 7A and 7B, like reference numerals are used for parts similar to those described with reference to FIG. 6. It will be seen that the further slotted element 30 incorporates a hood 150 for weather protection and an insect mesh screen 152.

The upper edge 14 of the flap includes a longitudinal seal 154 of resilient elastomeric material and the lower edge 16 of the flap includes a similar seal 156.

Mounted to the bearing element 26' is a pin 158 which is aligned substantially coaxial with axis of rotation of the flap 12 and thumb wheel 24.

Figure 10:
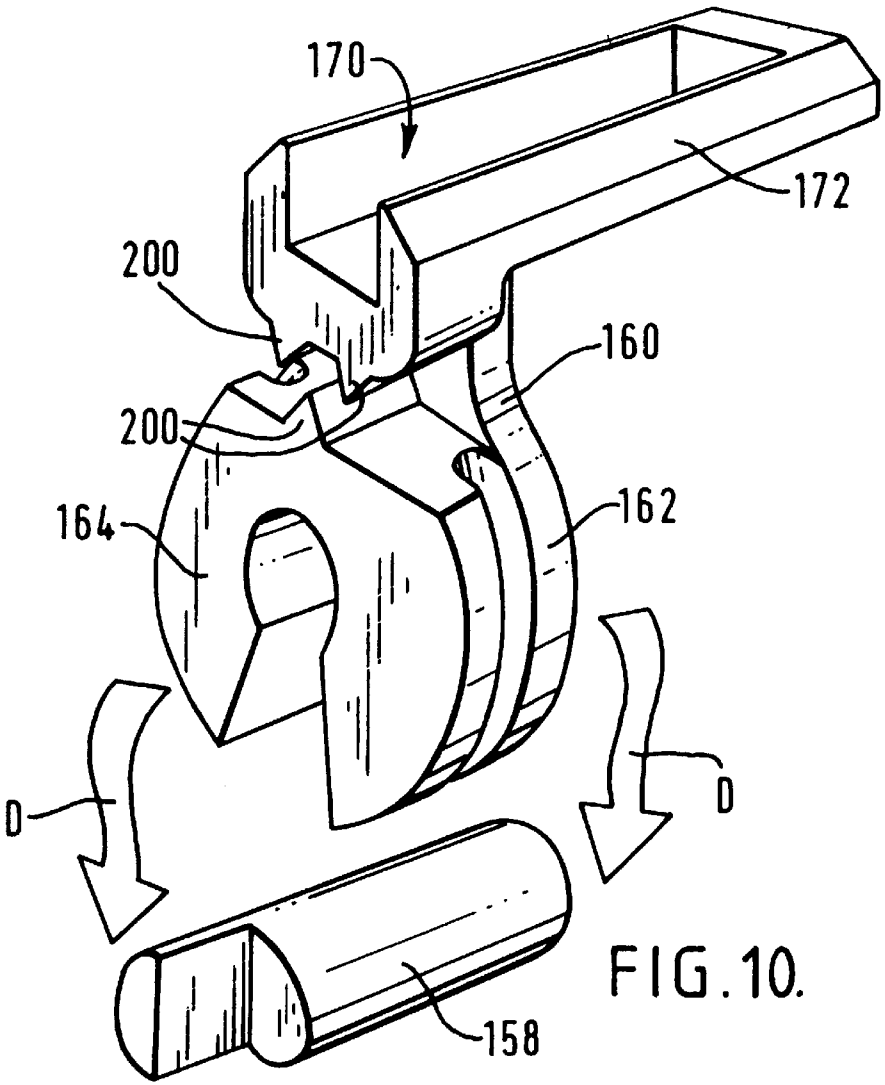
FIG. 10 shows a detailed view of the operation device of FIG. 8.
Figure 12:
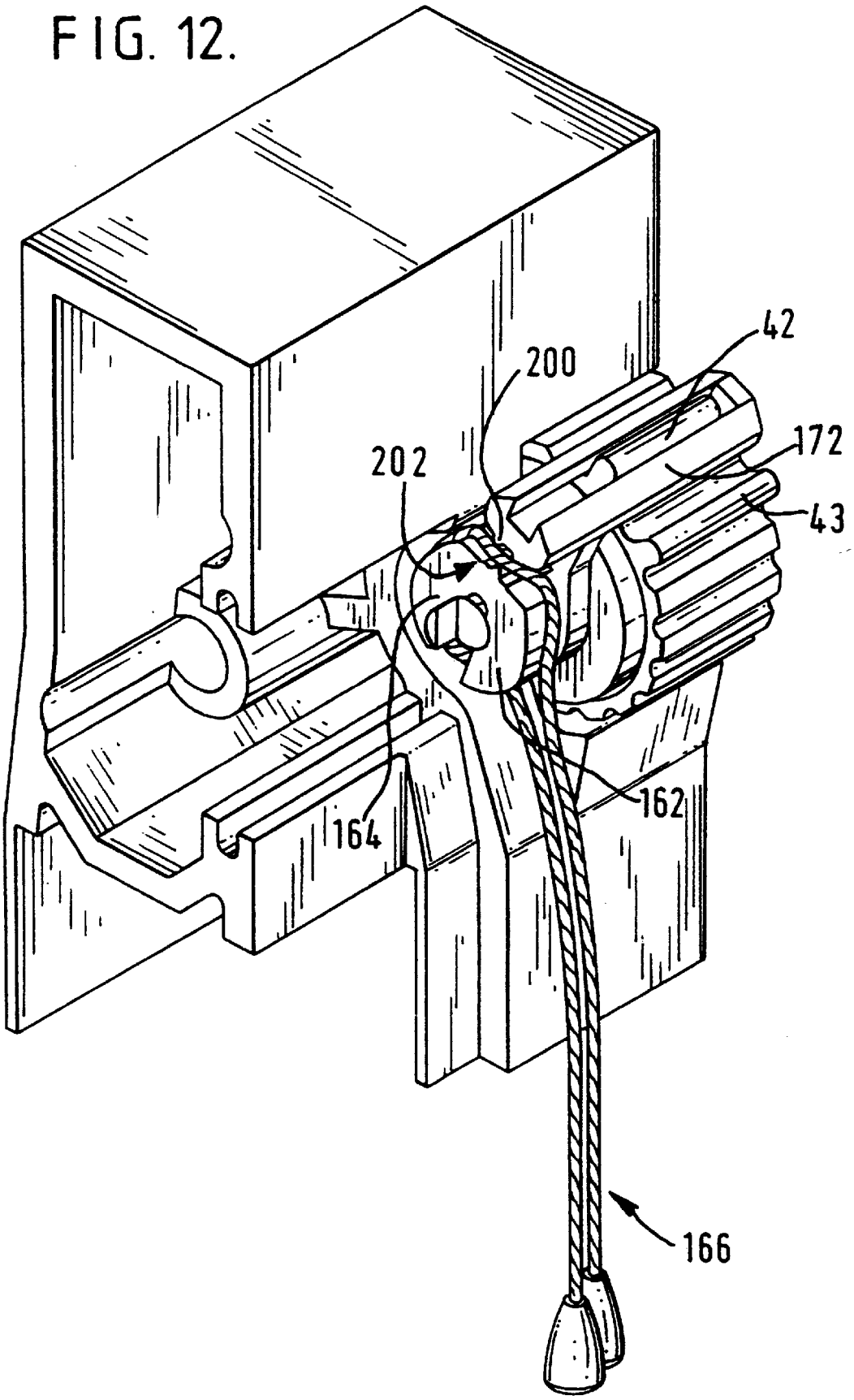
FIG. 12 shows a view of the operation device of FIGS. 8 and 10 connected to th e ventilator, with an operation cord attached.

The ventilator 100 may be fitted with a cord-operated operation device 160 (see FIGS. 8 and 10). Referring to FIG. 10, the operation device 160 includes a pair of resilient jaws 162, 164 which may be snap-fitted on to the pin 158 as shown by arrows D in FIG. 10. The operation device 160 incorporates a slotted portion 172 including a longitudinal slot 170. As shown in FIG. 12, the operation cord 166 is threaded around the periphery of the jaws 172, 164 and is trapped relative to the operation device by teeth 200 formed in a mouth portion 202 of the device 160. The two ends 168,174 of the cord 166 hang down from the ventilatior to a convenient height for operation thereof. One end 168 of the cord 166 may be pulled to rotate the operation device 160 about the pin 158 to the position shown in FIG. 7B, and the other end 174 may be pulled to rotate the operation device 160 to the position shown in FIG. 9. Normally, only one operation device 160 will be employed, on one 28" of the end caps of the ventilator. Since the operation device 160 is attached to the pin 158 with the projection 42 on the thumb wheel 24' engaging in the slot 172 of the operation device, the thumb wheel 24', and therefore also the flap 12, rotates with the operation device 160 as the cord 166 is operated. The operation device 100 is preferably a one piece plastics moulding.

Figure 11:
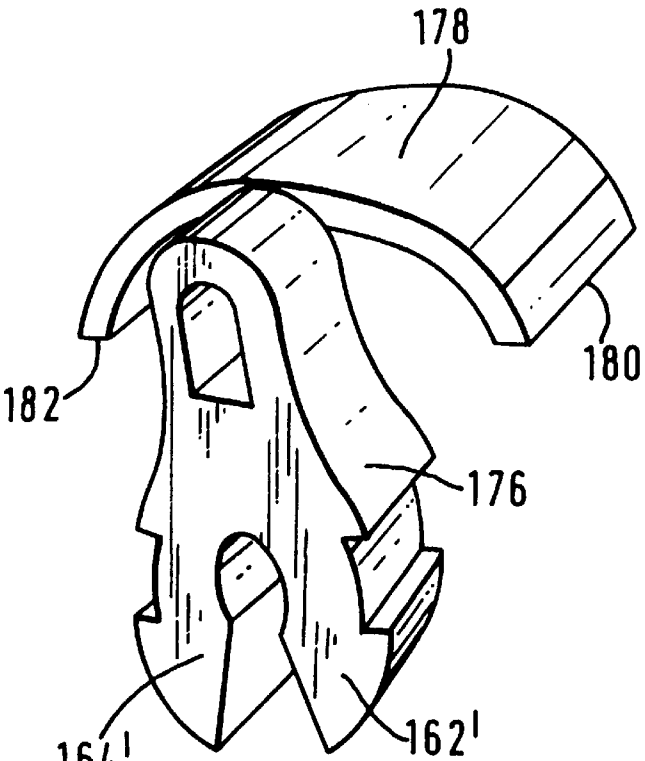
FIG. 11 shows an example of a permanent ventilation device for the ventilator of FIGS. 4 to 5, 7A and 7B.

Instead of the operation device 160, a permanent ventilation device 176 (see FIG. 11), which is preferably a one piece plastics moulding may be attached to the pin 158. In some circumstances, it is necessary for the ventilator 100 to be locked in an open position thereof, such as to comply with gas regulations. To fit the permanent ventilation device, the flap 12 is rotated to the fully open position of FIG. 7B. The jaws 162', 164' of the permanent ventilation device are then snap-fitted over the pin 158. In doing this, a blocking portion 178 of the device 176 is brought into a position adjacent to thumb wheel 24. The blocking portion 178 at least partially prevents an observer from being able to see the thumb wheel 24; when similar permanent ventilation devices 176 are attached at each end of the flap 12, this presents the observer from attempting to close the flap. In addition, the blocking portion 178 includes a front edge 180 arranged to engage against the projection 42 of the thumb wheel, and a rear edge 182 arranged to engage the front surface 44 of the end cap 28". Thus, the flap is locked in the open position and cannot be closed even if desired by the observer.

The thumb wheel 24' may in any of the above embodiments include a projection 42 similar to the one shown in FIGS. 1 and 2. In addition, a further projection 43 (see FIGS. 7A, 7B and 9) may be provided circumferentially spaced from the one depicted. This provides additional assistance for manual operation of the thumb wheel and, in addition, a further end stop for it.

Ventilators in accordance with the invention may be cut to length during assembly on site. Ventilators of any length are envisaged, but ventilators up to a length of approximately 1.5 meters will, it is thought, be most popular.

The ventilator is very easy to assemble and, once installed, does not take up too much space, for example glass area, above a window.

The ventilator is also preferably thermally broken by the use of suitable materials for the end caps and upper and lower connectors.

The ventilator may be applied to various thicknesses of window or door, for example by using upper and lower connectors and end caps 28' of different widths.

Another advantage of the ventilator is that it does not project into the room very much. It will be seen from, for example FIG. 6, that the flap 12 rotates about a fairly central axis thereof and that the forward moving upper edge 14 only projects the minimum amount into the room when the flap 12 is opened.

What is claimed is:

1. A ventilator comprising an elongate flap having first and second ends, first and second connection means located at the first and second ends respectively, the connection means connecting the flap to support means and being arranged to permit the flap to rotate about a longitudinal axis thereof, and biasing means including a tapered bearing, the tapered bearing biasing the first end along the longitudinal axis.

2. A ventilator as claimed in claim 1 in which the biasing means is included in the first connection means.

3. A ventilator as claimed in claim 1 in which the biasing means is arranged to bias the first end of the flap towards the location of the second end of the flap.

4. A ventilator as claimed in claim 1 in which the first and second connection means include respective spigot and bore connections which together define the longitudinal axis of the flap.

5. A ventilator as claimed in claim 1 in which the second connection means is selected from the group of (A) substantially identical to, or (B) substantially a mirror image of, the first connection means.

6. A ventilator as claimed in claim 1 in which the support means comprises a first end support at the first end of the flap, and a second end support at the second end of the flap, and a first slotted element extending between the end supports, the first slotted element including an aperture having upper and lower edges, the flap being rotatable between a closed position in which upper and lower edges thereof are located adjacent the upper and lower edges of the aperture, and an open ventilation position.

7. A ventilator as claimed in claim 6 in which the upper edge and the lower edge include sealing strips for sealing the aperture in the closed position.

8. A ventilator as claimed in claim 6 which includes a second slotted element having a second aperture and extending between the end supports, the second slotted element being spaced from the first slotted element by upper and lower connector means which extend between the end supports, the second aperture in the second slotted element and the aperture in the first slotted element defining the inlet and outlet of an airflow passage through the ventilator.

9. A ventilator as claimed in claim 8 in which the end supports and upper and lower connector means are of thermally insulating material.

10. A ventilator as claimed in claim 8 in which the first and second slotted elements include substantially parallel downwardly depending flanges which are spaced from one another to define a glazing channel.

11. A ventilator comprising an elongate flap having first and second ends, first and second connection means located at the first and second ends respectively, the connection means connecting the flap to support means and being arranged to permit the flap to rotate about a longitudinal axis thereof, and a bearing element located on one of the first end and the support means, and a resilient projection carried on the other of the first end and the support means, the bearing element having a tapered bearing surface substantially coaxial with the longitudinal axis of the flap, the projection engaging the tapered bearing surface biasing the first end along the longitudinal axis.

12. A ventilator as claimed in claim 11 in which the projection engages the bearing surface frictionally to couple the rotational orientation of the flap relative to the support means.

13. A ventilator as claimed in claim 11 in which the first connection means includes an intermediate carrier element which carries the projection, and the carrier element is mounted to the first end of the flap.

14. A ventilator as claimed in claim 13 in which the carrier element comprises a manually-rotatable operation element for rotating the flap.

15. A ventilator as claimed in claim 11 in which the resilient projection comprises a plurality of substantially parallel resilient projections carried on the first end and the support means in the form of a collet substantially coaxial with the bearing surface, each of the projections engaging the bearing surface.

16. A ventilator as claimed in claim 15 in which the first connection means includes an intermediate carrier element which carries the projection, and the carrier element is mounted to the first end of the flap; and in which the plurality of projections is carried on the carrier element on the flap.

17. A ventilator comprising an elongate flap having first and second ends, first and second connection means located at the first and second ends respectively, the connection means connecting the flap to support means and being arranged to permit the flap to rotate about a longitudinal axis thereof, the first connection means including a friction coupling comprising a bearing element located on one of the first end and the support means, and a resilient projection carried on the other of the first end and the support means, the bearing element having a substantially cylindrical or tapered bearing surface substantially coaxial with the longitudinal axis of the flap, the projection engaging the bearing surface frictionally to couple the rotational orientation of the flap relative to the support means.

18. A ventilator as claimed in claim 17 in which the bearing surface is substantially conical.

19. A ventilator as claimed in claim 18 in which the first connection means biases the first end of the flap towards the location of the second end thereof.

20. A ventilator as claimed in claim 17 in which the first connection means includes an intermediate carrier element which carries the projection, and the carrier element is mounted to the first end of the flap.

21. A ventilator as claimed in claim 20 in which the carrier element comprises a manually-rotatable operation element for rotating the flap.

22. A ventilator as claimed in claim 17 in which the resilient projection comprises a plurality of substantially parallel resilient projections carried on the other of the first end and the support means in the form of a collet substantially coaxial with the bearing surface, each of the projections engaging the bearing surface.

23. A ventilator as claimed in claim 17 in which the first and second connection means include respective spigot and bore connections which together define the longitudinal axis of the flap.

24. A ventilator as claimed in claim 17 in which the second connection means is selected from the group of (A) substantially identical to, or (B) substantially a mirror image of, the first connection means.

25. A ventilator as claimed in claim 17 in which the support means comprises a first end support at the first end of the flap, and a second end support at the second end of the flap, and a first slotted element extending between the end supports, the first slotted element including an aperture having upper and lower edges, the flap being rotatable between a closed position in which upper and lower edges thereof are located adjacent the upper and lower edges of the aperture, and an open ventilation position.

26. A ventilator as claimed in claim 25 in which the upper edge and the lower edge include sealing strips for sealing the aperture in the closed position.

27. A ventilator as claimed in claim 25 which includes a second slotted element extending between the end supports, the second slotted element being spaced from the first slotted element by upper and lower connector means which extend between the end supports, a second aperture in the second slotted element and the aperture in the first slotted element defining the inlet and outlet of an airflow passage through the ventilator.

28. A ventilator as claimed in claim 27 in which the end supports and upper and lower connector means are of thermally insulating material.

29. A ventilator as claimed in claim 27 in which the first and second slotted elements include substantially parallel downwardly depending flanges which are spaced from one another to define a glazing channel.

30. A ventilator as claimed in claim 22 in which the first connection means includes an intermediate carrier element which carries the projections, and the carrier element is mounted to the first end of the flap; and in which the plurality of projections is carried on the carrier element on the first end of the flap.

* * * * *